US011472018B2

(12) United States Patent
Numata

(10) Patent No.: US 11,472,018 B2
(45) Date of Patent: Oct. 18, 2022

(54) POWER TOOL

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 347 days.

(21) Appl. No.: 16/872,844

(22) Filed: May 12, 2020

(65) Prior Publication Data

US 2020/0384627 A1 Dec. 10, 2020

(30) Foreign Application Priority Data

Jun. 10, 2019 (JP) ..... JP2019-108152

(51) Int. Cl.

| | |
|---|---|
| ***B25F 5/02*** | (2006.01) |
| ***B24B 23/00*** | (2006.01) |
| *B24B 23/02* | (2006.01) |
| *B24B 47/12* | (2006.01) |

(52) U.S. Cl.

CPC ..... *B25F 5/026* (2013.01); *B24B 23/005* (2013.01); *B24B 23/02* (2013.01); *B24B 47/12* (2013.01)

(58) Field of Classification Search

CPC ..... B25F 5/026

USPC ..... 173/46, 162.1, 162.2, 170; 16/110.1

See application file for complete search history.

(56) References Cited

U.S. PATENT DOCUMENTS

| | | | | |
|---|---|---|---|---|
| 2006/0219419 | A1* | 10/2006 | Sugiyama | B25F 5/026 173/162.2 |
| 2013/0162188 | A1* | 6/2013 | Koeder | B25F 5/026 318/434 |
| 2014/0231113 | A1* | 8/2014 | Steurer | B25F 5/02 173/1 |
| 2017/0239803 | A1* | 8/2017 | Aoki | B25F 5/008 |
| 2018/0272494 | A1* | 9/2018 | Schadow | B25F 5/026 |

FOREIGN PATENT DOCUMENTS

| | | | |
|---|---|---|---|
| WO | 2017/051892 | A1 | 3/2017 |

* cited by examiner

*Primary Examiner* — Eyamindae C Jallow
(74) *Attorney, Agent, or Firm* — Oliff PLC

(57) ABSTRACT

A power tool includes a handle detector that is less susceptible to vibrations and is highly durable and reliable. A grinder includes a brushless motor, an inner housing accommodating the brushless motor, a rubber cylinder, a spindle driven by the brushless motor, and an outer housing enclosing the inner housing and holding the inner housing with the rubber cylinder in between. The outer housing includes a handle mount and at least one handle detector that detects a side handle attached.

15 Claims, 10 Drawing Sheets

POWER TOOL

CROSS-REFERENCE TO RELATED APPLICATIONS

This application claims the benefit of priority to Japanese Patent Application No. 2019-108152, filed on Jun. 10, 2019, the entire contents of which are hereby incorporated by reference.

BACKGROUND

1. Technical Field

The present invention relates to a power tool such as a grinder.

2. Description of the Background

A grinder described in, for example, WO 2017/51892, includes a housing extending in the front-rear direction with its rear portion serving as a main handle. An auxiliary side handle is attachable selectively on the right or left front of the housing. An operator holds the rear of the housing with one hand and the side handle with the other hand and operates the grinder to perform grinding or other operations.

BRIEF SUMMARY

Such a known power tool includes a detector for detecting a side handle attached to prevent the power tool from operating without the side handle being attached. However, the detector directly attached to the housing may be susceptible to vibrations generated during operation, and may be less durable or may malfunction.

One or more aspects of the present invention are directed to a power tool including a handle detector that is less susceptible to vibrations and is highly durable and reliable.

An aspect of the present invention provides a power tool capable of detecting a side handle attached, the power tool including:

a motor;

an inner housing accommodating the motor;

an elastic member;

a final output shaft driven by the motor; and an outer housing enclosing the inner housing and holding the inner housing with the elastic member in between, the outer housing including a mount to which the side handle is attachable, and at least one handle detector configured to detect the side handle attached.

The power tool according to the above aspect includes a handle detector that is less susceptible to vibrations and is highly durable and reliable.

DETAILED DESCRIPTION

Embodiments of the present invention will now be described with reference to the drawings.

Figure 1:
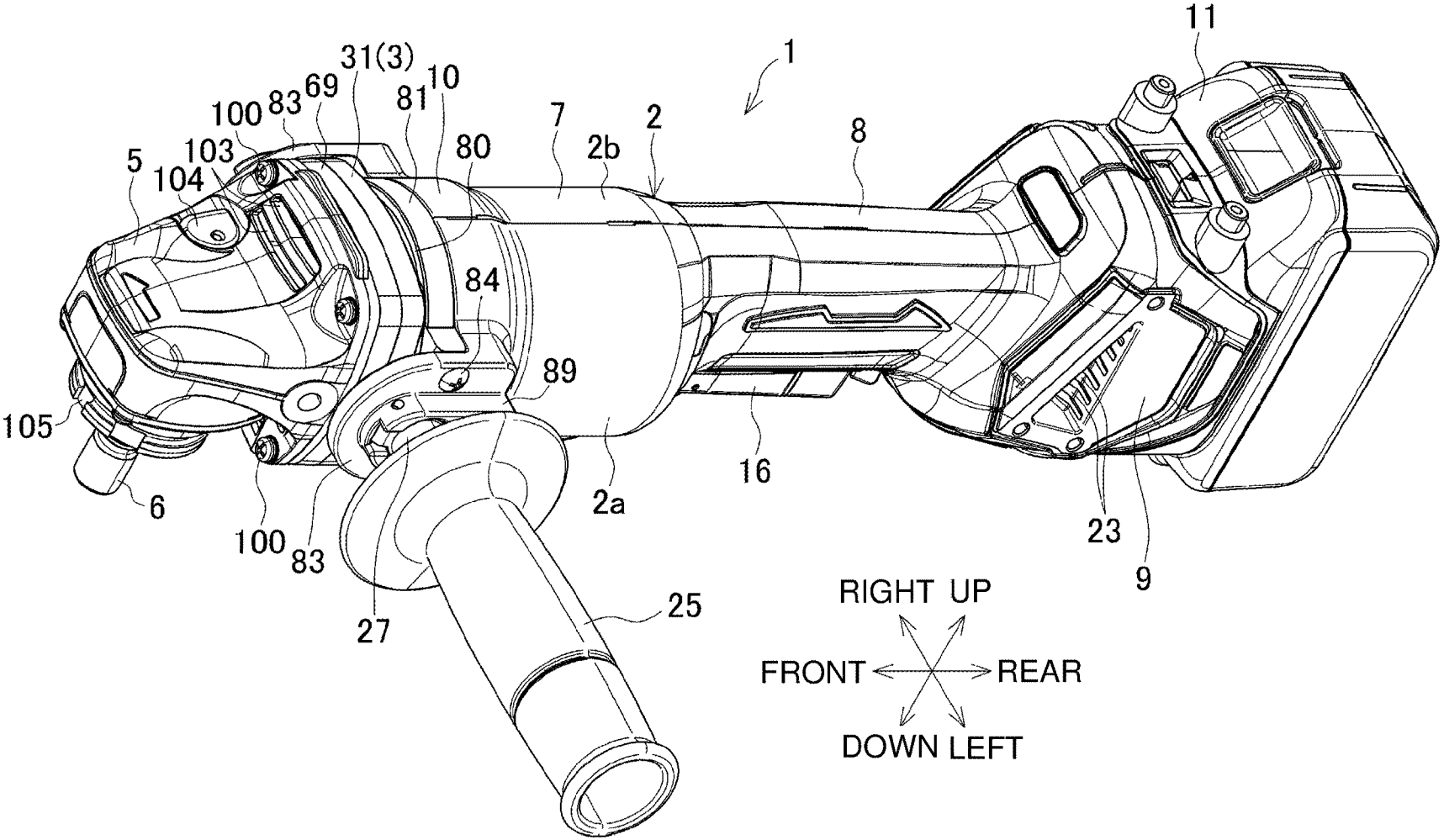
FIG. 1 is a perspective view of a grinder.
Figure 2:
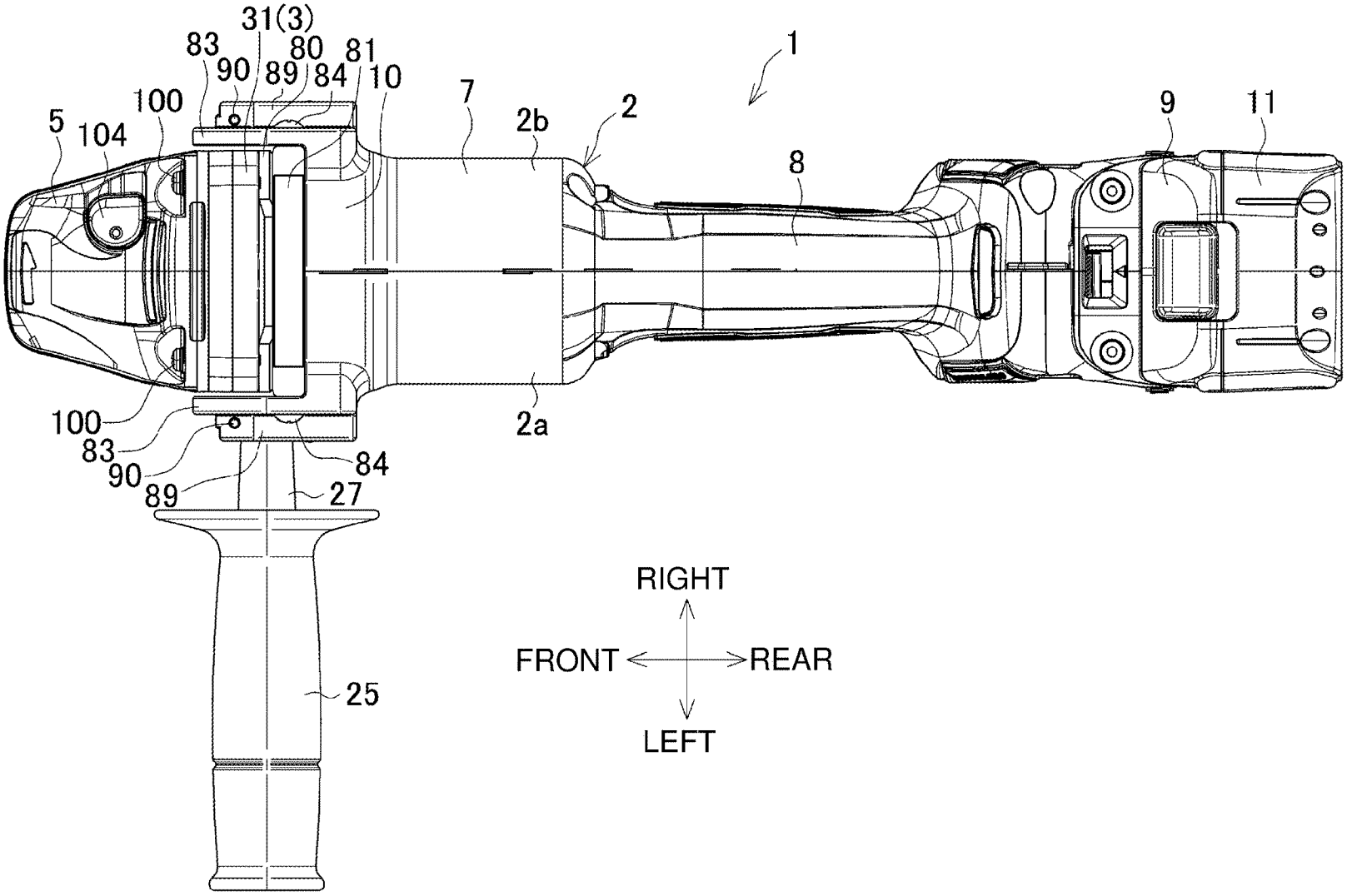
FIG. 2 is a plan view of the grinder.
Figure 3:
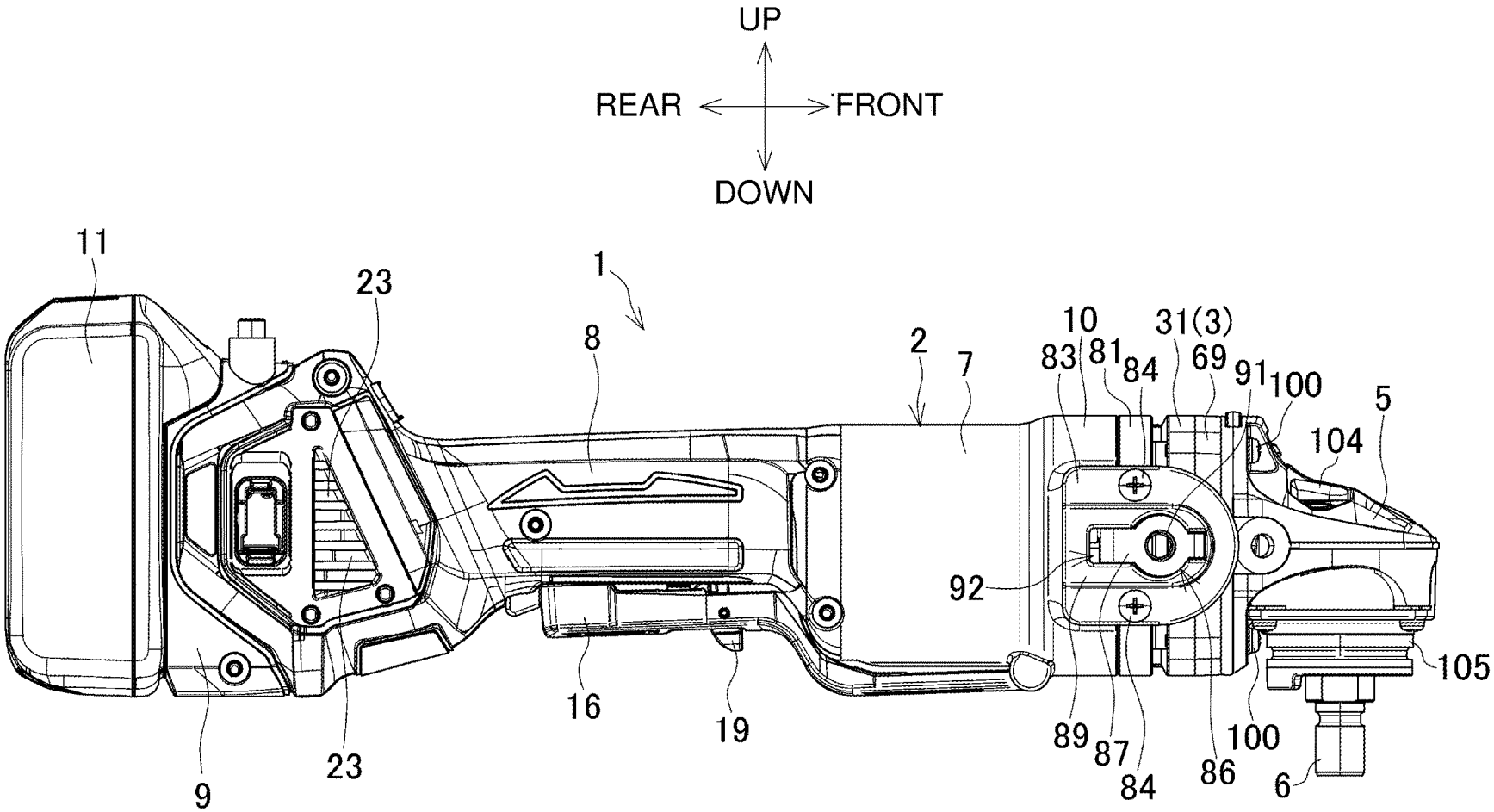
FIG. 3 is a left side view of the grinder.
Figure 4:
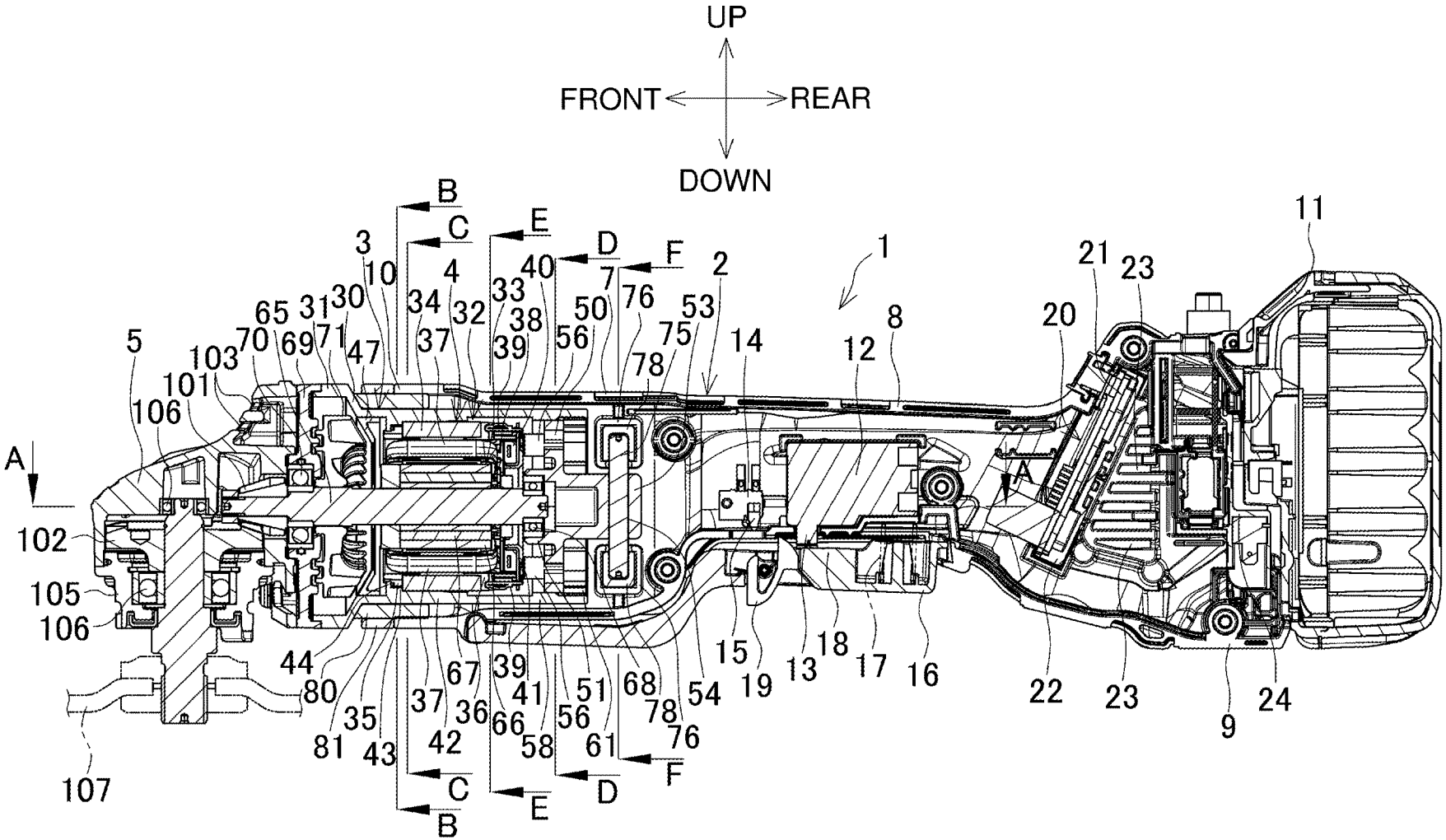
FIG. 4 is a longitudinal central sectional view of the grinder.

FIG. 1 is a perspective view of a rechargeable grinder as an example of a power tool. FIG. 2 is a plan view of the grinder. FIG. 3 is a left side view of the grinder. FIG. 4 is a longitudinal central sectional view of the grinder.

A grinder 1 includes a housing including an outer housing 2, an inner housing 3, and a gear housing 5. The outer housing 2 is cylindrical and extends in the front-rear direction. The inner housing 3 is cylindrical and is located inside the outer housing 2. The inner housing 3 holds a brushless motor 4 and protrudes frontward. The gear housing 5 is connected to the front of the inner housing 3 and accommodates the spindle 6 protruding downward.

The outer housing 2 is formed from a resin and integrally includes a front cylinder 7 with a larger-diameter, a rear cylinder 8 with a smaller-diameter, and a battery mount 9. The front cylinder 7 holds the inner housing 3. The rear cylinder 8 is located behind and decentered upward from the front cylinder 7. The battery mount 9 is located at the rear end of the rear cylinder 8. The outer housing 2 is assembled by fastening a pair of right and left half housings 2*a* and 2*b* with screws.

The front cylinder 7 has, at its front end, a larger-diameter portion 10 with an increased diameter. The battery mount 9 can receive a battery pack 11 as a power supply in a manner slidable from above.

The rear cylinder 8 receives a main switch 12 including a plunger 13, which protrudes downward. The main switch 12 includes a mechanical contact to be turned on to electrically connect a terminal mount 24 (described later) to a control circuit board 21. The mechanical contact is switchable by operating the plunger 13. A microswitch 14 including a button 15 protruding downward is located in front of the main switch 12 in the rear cylinder 8. The microswitch 14 includes an electrical contact to be turned on to electrically connect the control circuit board 21 to the brushless motor 4. The electrical contact is switchable by operating the button 15. A switch lever 16 is vertically swingable on a lower surface of the outer housing 2. The switch lever 16 is pivotable about its front end and extends rearward while bending in conformance with the lower surfaces of the front cylinder 7 and the rear cylinder 8. A coil spring 17 between the rear of the switch lever 16 and the lower surface of the rear cylinder 8 urges the switch lever 16 downward to a protruding position in a normal state.

The switch lever 16 includes a pressing plate 18 and a lock-off lever 19. The pressing plate 18 is pressed upward to press the plunger 13. The lock-off lever 19 is located in front of the pressing plate 18. The lock-off lever 19 in a normal state is urged rotationally into a vertical posture shown in FIG. 4, restricting the switch lever 16 from being pressed. The lock-off lever 19 in FIG. 4 is rotatable counterclockwise to allow the switch lever 16 to be pressed. The rear cylinder 8 is used as a main handle. An operator rotates the lock-off lever 19 counterclockwise with fingers holding the rear cylinder 8 and then grips the switch lever 16. This causes the pressing plate 18 to press the plunger 13 and subsequently the lock-off lever 19 to press the button 15.

A controller 20 behind the main switch 12 is supported in a tilt posture with its lower end more frontward than its upper end with respect to the axis of the rear cylinder 8. The controller 20 includes a dish-shaped case 22, which is formed from aluminum. The case 22 accommodates the control circuit board 21. The control circuit board 21 receives, for example, six field-effect transistors (FETs) (not shown) corresponding to coils 37 in the brushless motor 4, a capacitor, and a microcomputer (not shown). The battery mount 9 has inlets 23 as slits on its right and left side surfaces behind the controller 20. The terminal mount 24 is held vertically behind the inlets 23. The terminal mount 24 is electrically connectable when the battery pack 11 is slide-attached from above.

The electric components other than the brushless motor 4 are accommodated in the outer housing 2 behind the inner housing 3 as described above.

Figure 5:
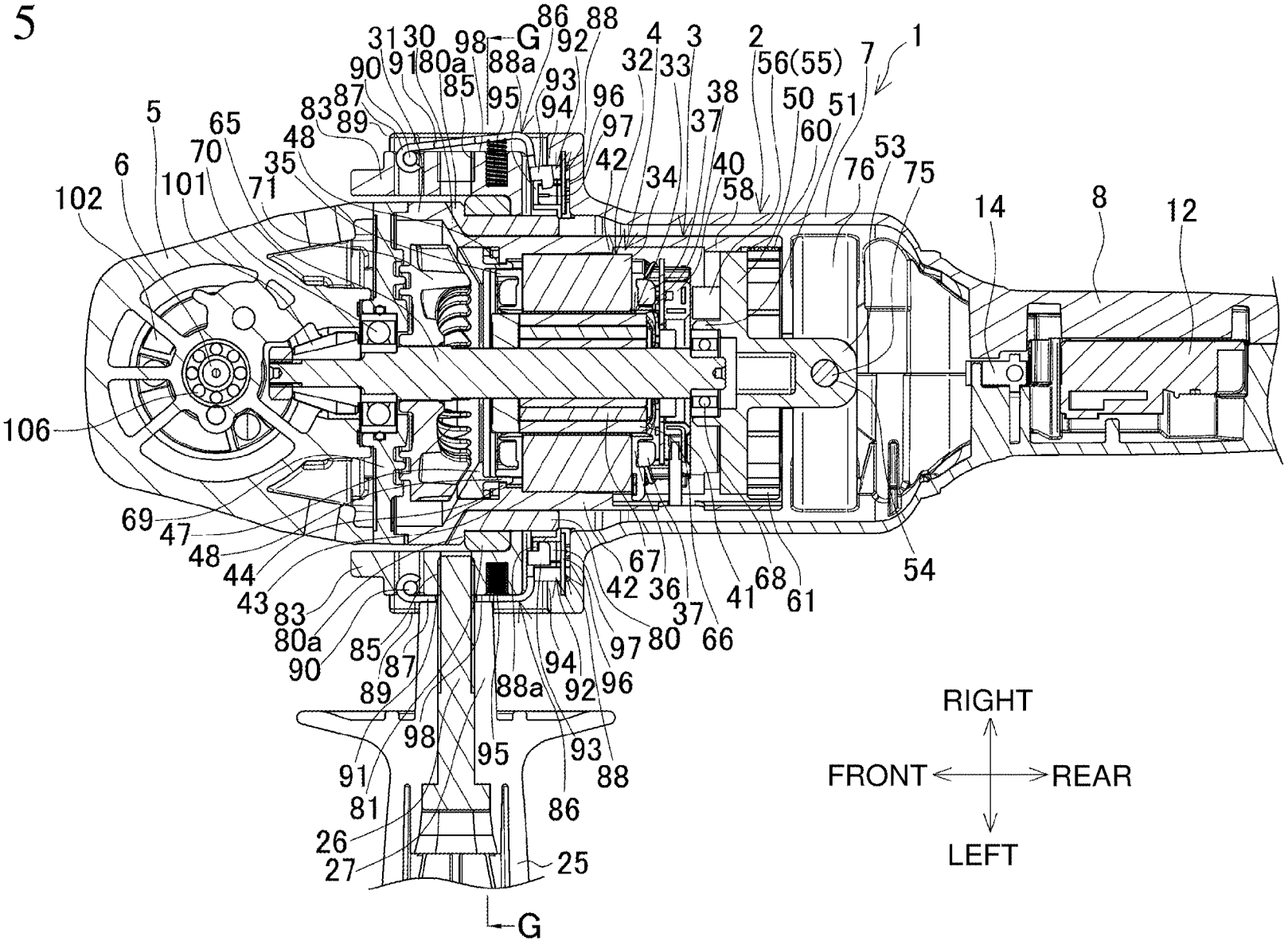
FIG. 5 is an enlarged partial sectional view taken along line A-A in FIG. 4.

The inner housing 3 is formed from a resin and has a smaller diameter than the front cylinder 7 to be enclosed in the front cylinder 7. As shown in FIG. 5, the inner housing 3 has a flared portion 30 and an expanded portion 31 at its front end protruding frontward from the outer housing 2. The flared portion 30 has diameters increasing frontward. The expanded portion 31 extends frontward from the front end of the flared portion 30 and has substantially the same outer diameter as the larger-diameter portion 10.

The brushless motor 4 is an inner-rotor motor including a cylindrical stator 32 and a rotor 33 extending through the stator 32. The stator 32 includes a cylindrical stator core 34, a front insulator 35, a rear insulator 36, and the coils 37. The stator core 34 includes multiple steel plates stacked on one another. The front insulator 35 is located on the axially front end face of the stator core 34. The rear insulator 36 is located on the axially rear end face of the stator core 34. The coils 37 are wound around the stator core 34 with the front and rear insulators 35 and 36 in between. A sensor circuit board 38 and a wire connection member 40 are attached to the rear insulator 36. The sensor circuit board 38 detects the positions of permanent magnets 67 placed in a rotor core. The wire connection member 40 includes a terminal fitting 41 for connecting the coils 37 with fuse terminals 39.

Figure 6B:
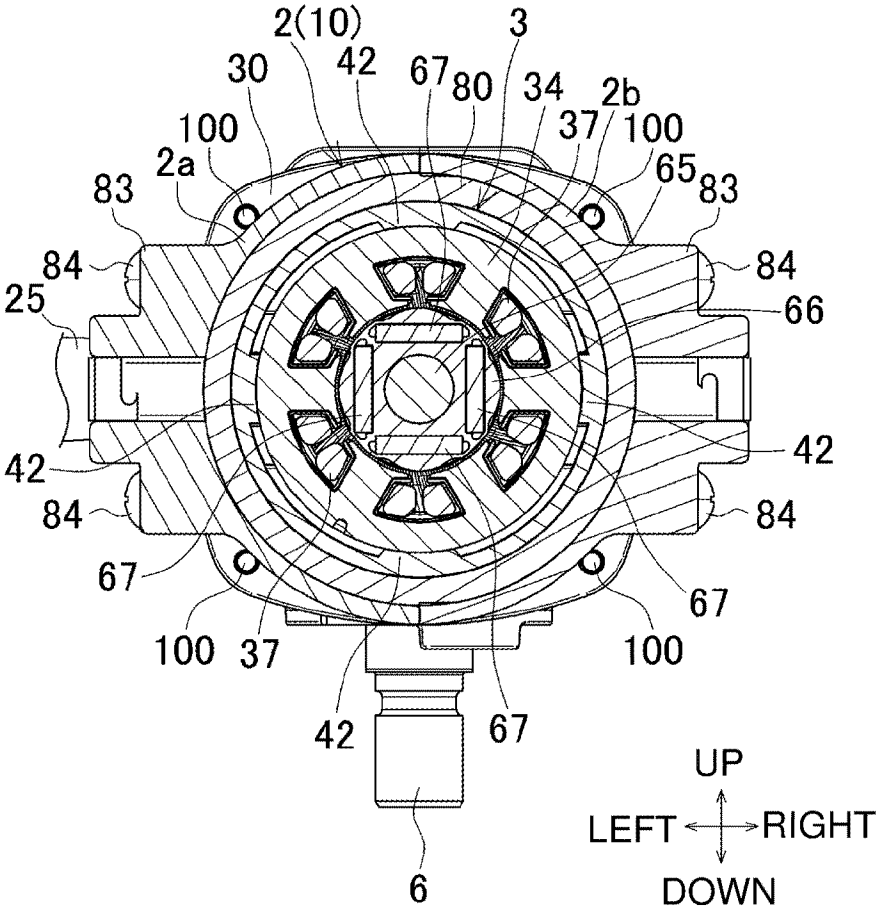
FIG. 6B is an enlarged cross-sectional view taken along line C-C in FIG. 4.
Figure 6A:
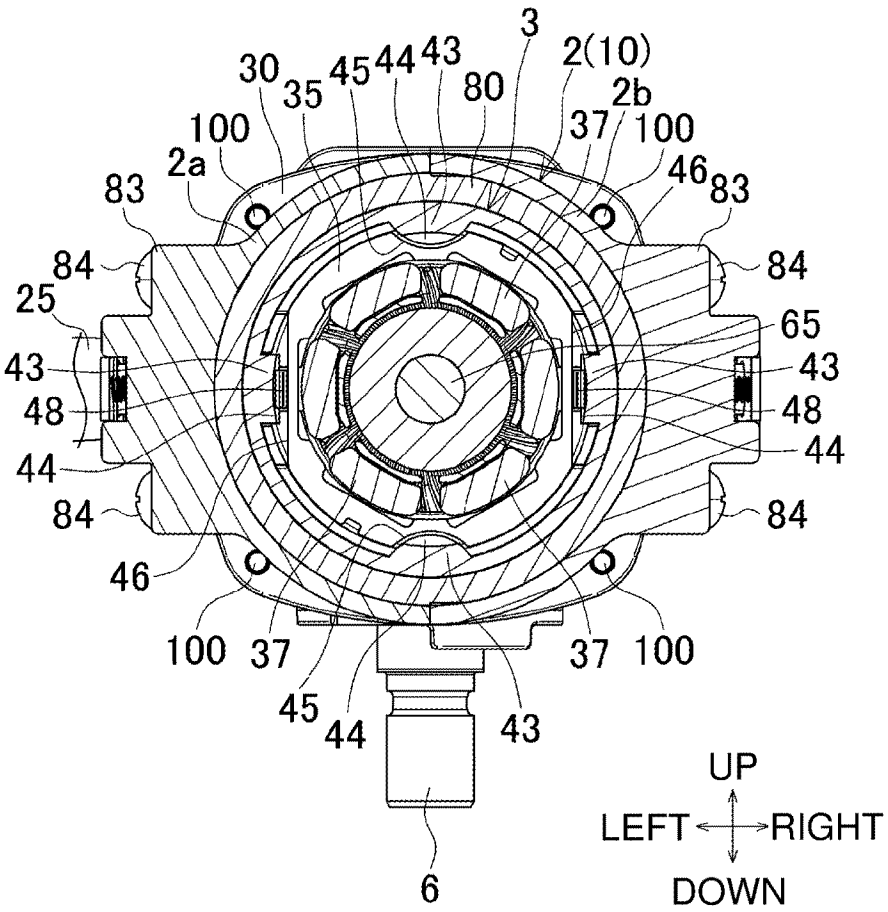
FIG. 6A is an enlarged cross-sectional view taken along line B-B in FIG. 4.
Figure 9:
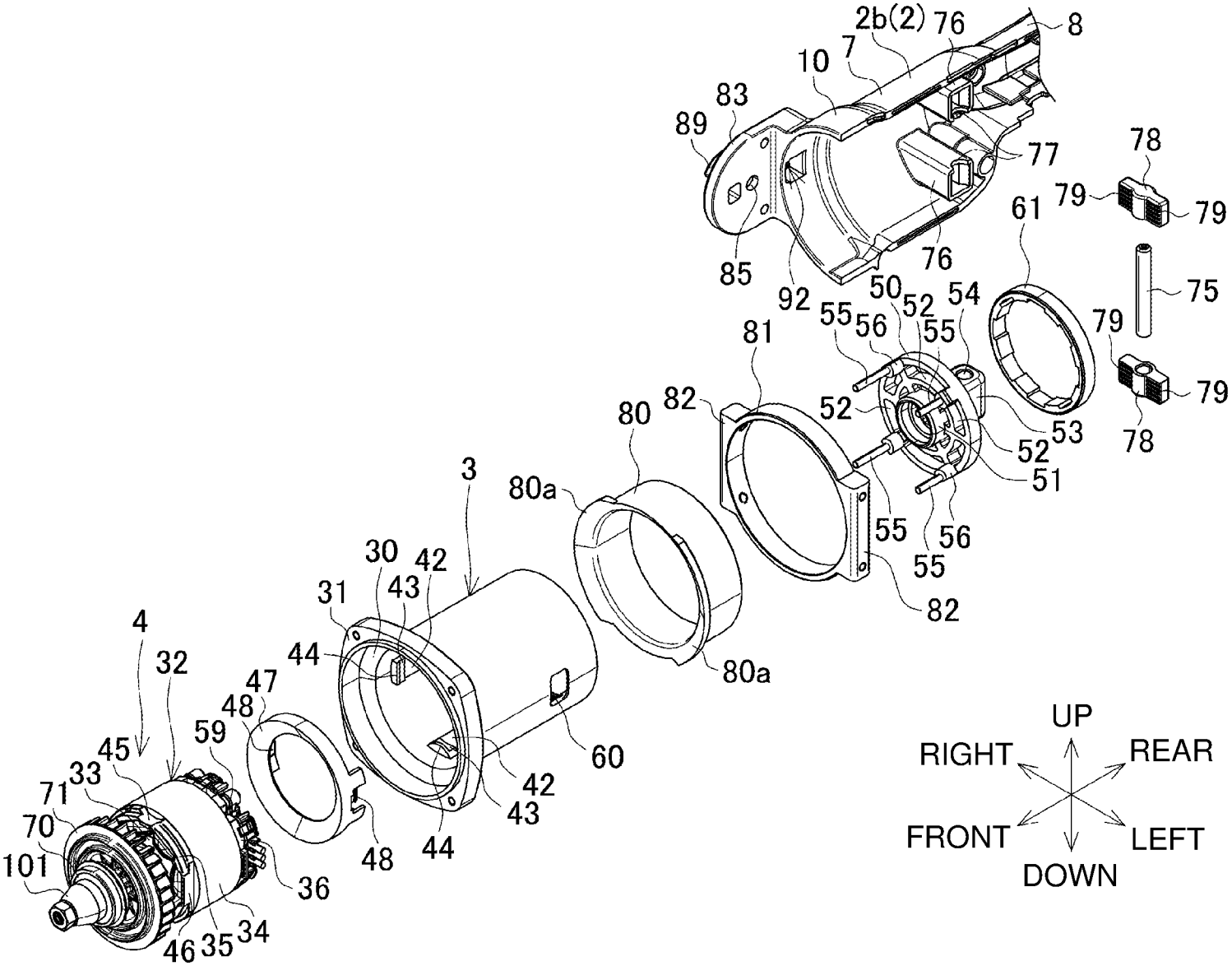
FIG. 9 is an exploded perspective view of an inner housing and a brushless motor, showing their holding structures.

As shown in FIGS. 6A, 6B, and 9, the inner housing 3 has, on its inner front surface, four protrusions 42 elongated in the front-rear direction and protruding toward the axis. The protrusions 42 are arranged at circumferentially equal intervals. Each protrusion 42 has a first projection 43 and a second projection 44 on its front. The first projection 43 and the second projection 44 project more from the inner surface (or become thicker) in a stepwise manner toward the front of the inner housing 3.

The front insulator 35 has a pair of upper and lower fitting recesses 45 and a pair of right and left flat edges 46. The pair of upper and lower fitting recesses 45 are fitted with the second projections 44 when circumferentially aligned with the upper and lower protrusions 42. The pair of right and left flat edges 46 are in no contact with the second projections 44 when circumferentially aligned with the right and left protrusions 42.

The stator 32 is placed into the inner housing 3 from the rear with the fitting recesses 45 circumferentially aligned with the upper and lower protrusions 42 and the flat edges 46 circumferentially aligned with the right and left protrusions 42. The fitting recesses 45 are fitted with the second projections 44 on the upper and lower protrusions 42, thus locking the stator 32 in a nonrotatable manner. The stator core 34 is in contact with the first projections 43 on the protrusions 42. This defines an advanced position of the stator core 34. In this state, the inner surfaces of the protrusions 42 excluding the first and second projections 43 and 44 are in contact with the outer surface of the stator core 34 as shown in FIG. 6B, thus holding the stator core 34.

A ring baffle plate 47 is fitted onto the fronts of the protrusions 42 from the front in the inner housing 3. As shown in FIGS. 5 to 6B, the baffle plate 47 includes right and left hooks 48, which are engaged with, outside the flat edges 46 of the front insulator 35, the second projections 44 on the right and left protrusions 42. This positions the baffle plate 47.

Figure 7B:
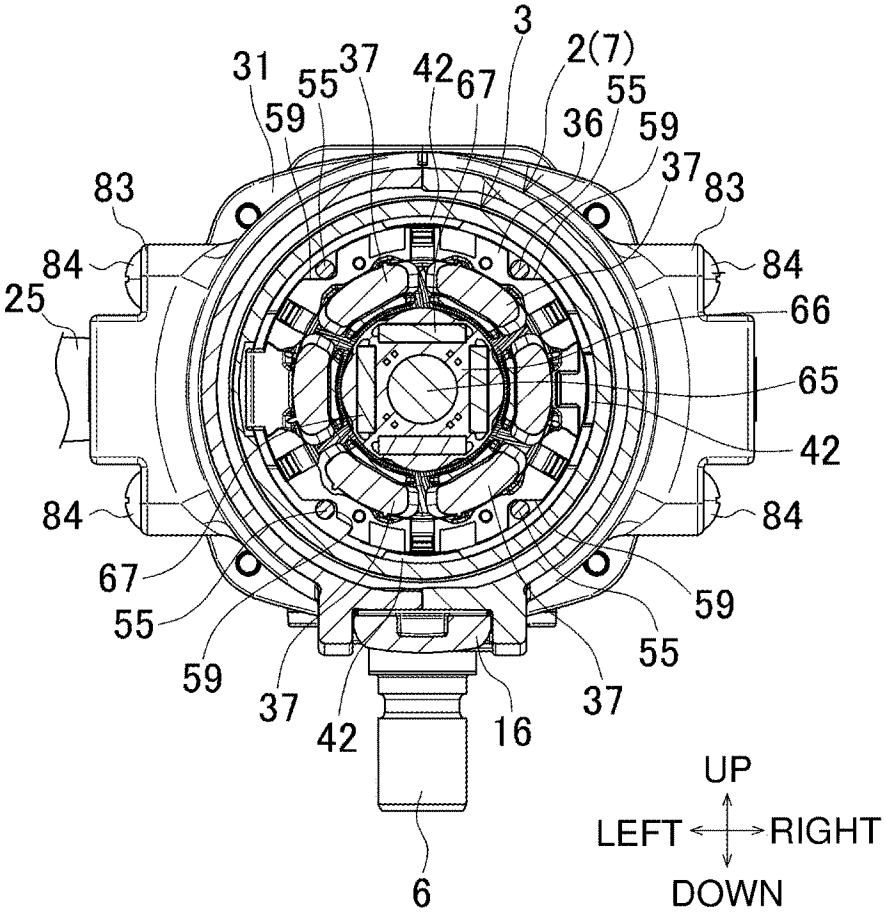
FIG. 7B is an enlarged cross-sectional view taken along line E-E in FIG. 4.
Figure 7A:
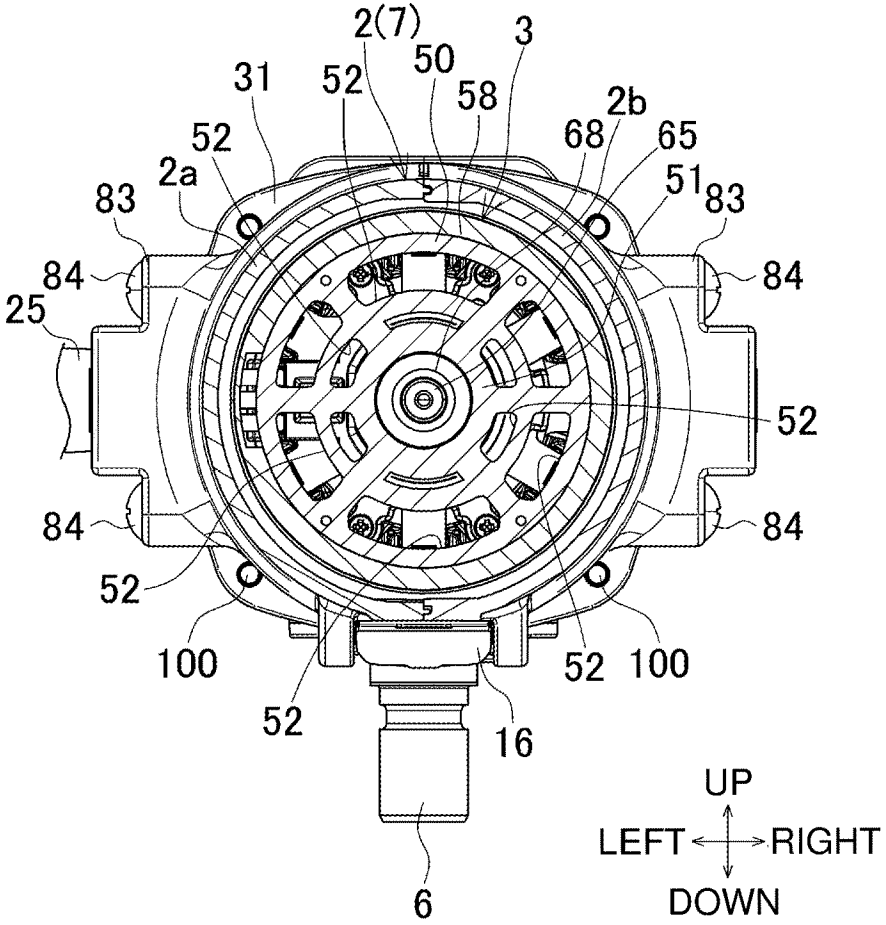
FIG. 7A is an enlarged cross-sectional view taken along line D-D in FIG. 4.

A metal bearing retainer 50 is fitted onto the rear end of the inner housing 3 from the rear. The bearing retainer 50 is disk-shaped and includes a bearing holder 51, multiple arch-shaped through-holes 52, and a joint 53. The bearing holder 51 is at the center of the bearing retainer 50 and has an opening facing frontward. The arch-shaped through-holes 52 surround the bearing holder 51 as shown in FIGS. 7A and 9. The joint 53 is at the rear of the bearing holder 51. The joint 53 protrudes rearward and has a through-hole 54 extending vertically.

The bearing retainer 50 includes four pins 55 protruding from its front surface. The pins 55 are arranged concentrically at equal intervals. Each pin 55 has a larger diameter at a basal portion 56.

The inner housing 3 has a thick portion 58 raised from its inner rear surface. The thick portion 58 has an inner diameter fittable with the bearing retainer 50. Four V-shaped notches 59 are formed on the outer circumference of the rear insulator 36 at circumferentially equal intervals as shown in FIG. 7B.

The pins 55 are circumferentially aligned with the corresponding notches 59 in the rear insulator 36 to place the bearing retainer 50 into the thick portion 58 of the inner housing 3 from the rear. The pins 55 are then engaged with the notches 59 and in contact with the rear surface of the stator core 34 as shown in FIG. 7B. The basal portions 56 are thus located adjacent to the rear surface of the rear insulator 36.

The bearing retainer 50 has an internal thread 60 on its inner circumference at the rear. With the bearing retainer 50 being placed in the thick portion 58, a resin lock ring 61 is screwed onto the internal thread 60. The lock ring 61 thus presses the bearing retainer 50 from the rear, preventing the bearing retainer 50 from slipping off. In this state, the joint 53 protrudes rearward from the inner housing 3 through the center of the lock ring 61.

The rotor 33 includes a rotational shaft 65, a rotor core 66, and the four permanent magnets 67. The rotational shaft 65 is aligned with the axis of the rotor 33. The rotor core 66 surrounds the rotational shaft 65. The rotor core 66 is substantially cylindrical and includes multiple steel plates stacked on one another. The permanent magnets 67 are plates fixed inside the rotor core 66.

The rotational shaft 65 has its rear end axially supported by the bearing 68. The bearing 68 is held in the bearing holder 51 of the bearing retainer 50. The rotational shaft 65 has its front end axially supported by the bearing 70. The bearing 70 is held on a partition 69 attached between the gear housing 5 and the expanded portion 31 of the inner housing 3. The distal end of the rotational shaft 65 protrudes into the gear housing 5. The rotational shaft 65 receives a centrifugal fan 71 behind the partition 69. The centrifugal fan 71 is in front of the baffle plate 47 and is accommodated in the flared portion 30 and the expanded portion 31.

The inner housing 3 holding the brushless motor 4 is elastically held on the outer housing 2. An elastic holding structure will now be described in detail.

Figure 8B:
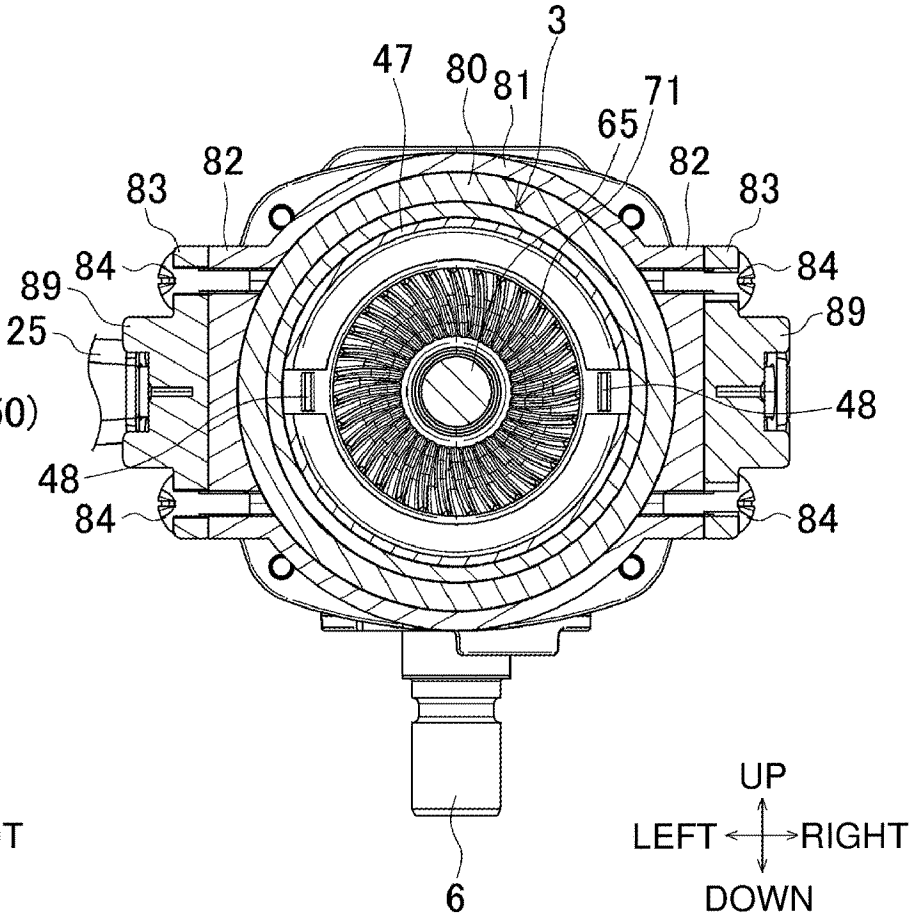
FIG. 8B is an enlarged cross-sectional view taken along line G-G in FIG. 5.
Figure 8A:
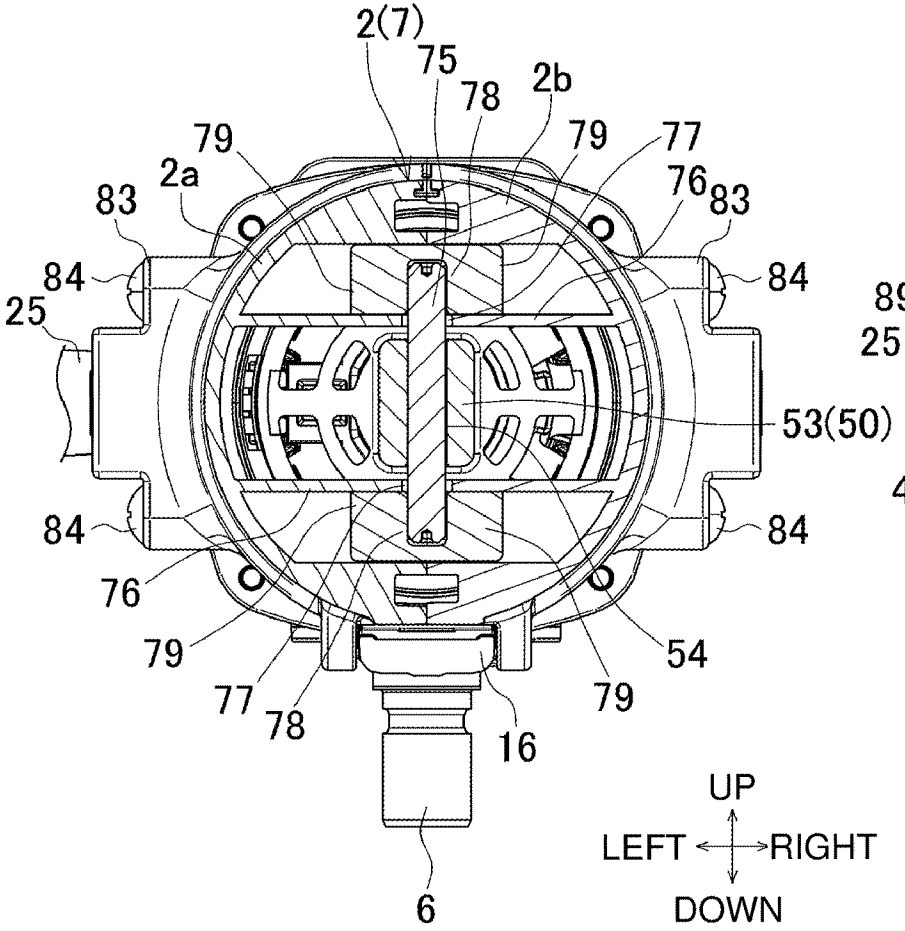
FIG. 8A is an enlarged cross-sectional view taken along line F-F in FIG. 4.

In the bearing retainer 50, a through-hole 54 in the joint 53, which protrudes rearward from the inner housing 3, receives a metal connecting rod 75 extending vertically. The connecting rod 75 has upper and lower ends supported in a pair of upper and lower rod receivers 76, which are hollow prisms as shown in FIGS. 8A and 9. The pair of upper and lower rod receivers 76 each include two half parts on the half housings 2*a* and 2*b* of the outer housing 2 that are combined together. The rod receivers 76 each have an insertion hole 77 for receiving the connecting rod 75 at the interface between the half parts. The rod receivers 76 each hold a rubber cap 78, which receives an end of the connecting rod 75 extending through the insertion hole 77. The rubber cap 78 has a pair of ends 79 extending laterally. Each end 79 is placed into and supported in the corresponding half parts of the rod receiver 76.

The connecting rod 75 extending through the joint 53 is supported in the rod receivers 76, thus holding the inner housing 3 in a laterally swingable manner about the connecting rod 75. The upper and lower ends of the connecting rod 75, which serves as a pivot, are elastically held in the rod receivers 76 with the rubber caps 78.

A rubber cylinder 80 is externally mounted on the outer circumference of the inner housing 3 to cover from the flared portion 30 to a rear portion. The rubber cylinder 80 is held between the larger-diameter portion 10 of the outer housing 2 and the inner housing 3. The rubber cylinder 80 has flanges 80*a* on the right and left edges. The flanges 80*a* are arch-shaped in conformance with the rear surface of the flared portion 30. The inner housing 3 laterally swingable about the connecting rod 75, which is elastically held in the rubber caps 78, is elastically held on the outer housing 2 along its entire front circumference with the rubber cylinder 80 in between. The rubber cap 78 has a lower hardness than the rubber cylinder 80.

A fixing ring 81 is externally mounted on the rubber cylinder 80 between the flared portion 30 and the larger-diameter portion 10. The fixing ring 81 is formed from a metal and has the same outer diameter as the larger-diameter portion 10. The fixing ring 81 has a pair of flat surfaces 82 extending vertically on its right and left side surfaces.

As shown in, for example, FIGS. 2 and 5, a pair of handle mounts 83 are integrally formed on the right and left side surfaces at the front end of the outer housing 2. The pair of handle mounts 83 protrude laterally outward and extend frontward to cover the outer surfaces of the gear housing 5 without being in contact with the outer surfaces of the inner housing 3 and the partition 69. Each handle mount 83 is used to attach a side handle 25 (e.g., FIGS. 1 and 2). Each handle mount 83 is flat on a plane defined in vertical and lateral directions. As shown in FIG. 8B, the handle mounts 83 in contact with the flat surfaces 82 of the fixing ring 81 at their inner surfaces are fastened to the fixing ring 81 with pairs of upper and lower screws 84, which are screwed from outside, or from the right and the left. The right and left half housings 2*a* and 2*b* of the outer housing 2 are thus fastened to the fixing ring 81 through the handle mounts 83, in addition to being directly fastened to each other with the screws.

As shown in FIGS. 5 and 9, each handle mount 83 has, in a middle portion in the front-rear and vertical directions, a screw hole 85 that is a laterally extending through-hole. The side handle 25 includes a threaded portion 26 at its distal end, which is screwed into the screw hole 85 and is fixed. Each handle mount 83 includes a handle detector 86 that detects the side handle 25 attached in the screw hole 85.

Figure 10:
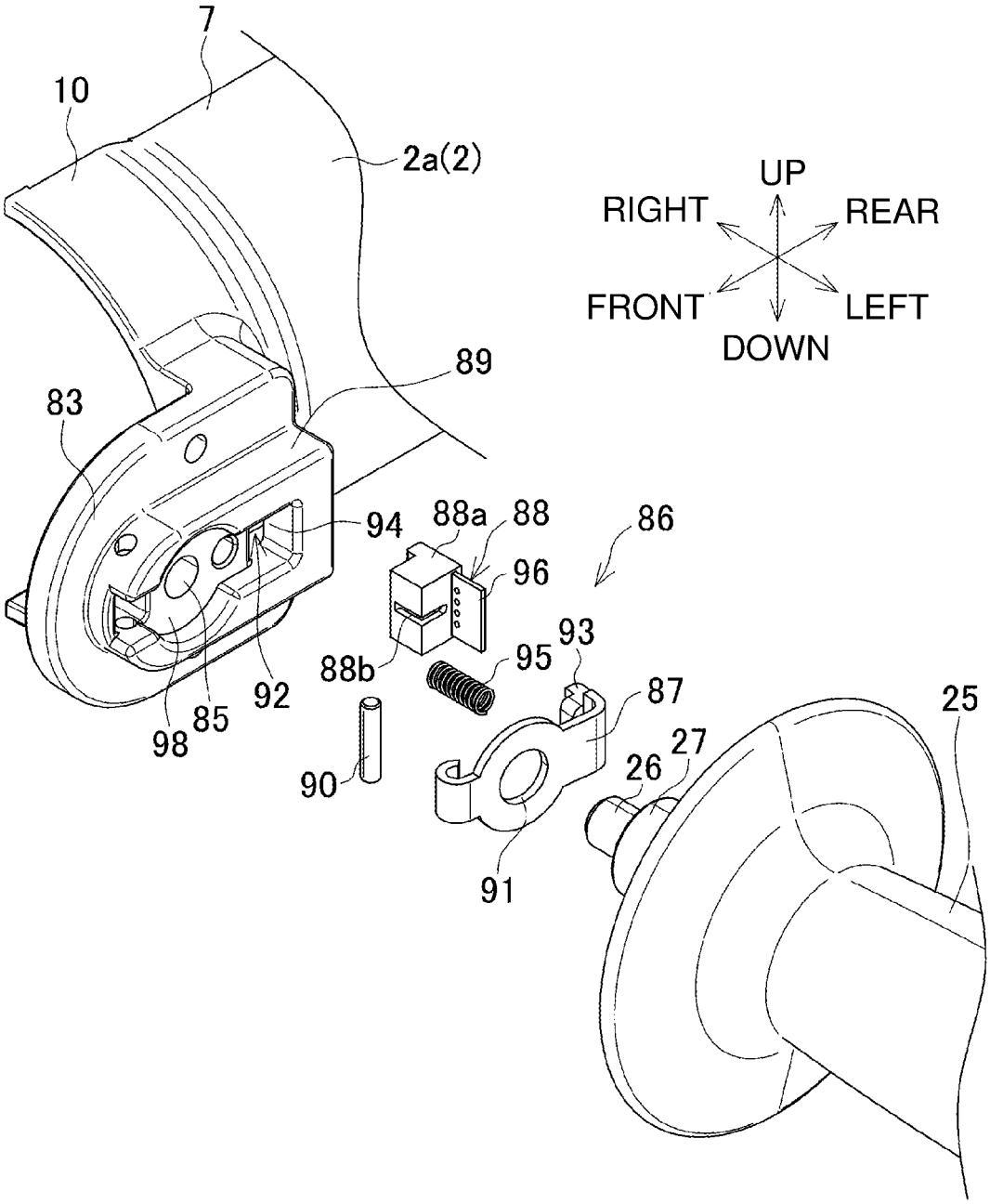
FIG. 10 is an exploded perspective view of a handle detector.

Each handle detector 86 includes a detection plate 87 and a photointerrupter 88 as shown in FIG. 10. The detection plate 87 is at a different position depending on whether the side handle 25 has been attached. The photointerrupter 88 detects the position of the detection plate 87 when the side handle 25 is attached, and outputs a detection signal to the controller 20. In response to the detection signal about the side handle 25, the controller 20 allows the brushless motor 4 to operate.

A pivot pin 90 is vertically supported in a frame 89 protruding on the outer surface of the handle mount 83. The detection plate 87 has a front portion pivotably attached to the pivot pin 90 and a rear portion swingable laterally. The detection plate 87 has, behind the pivot pin 90, a through-hole 91 located outside the screw hole 85. The through-hole 91 can receive the threaded portion 26 of the side handle 25.

The detection plate 87 has a rear end bending inward toward the handle mount 83. The rear end is placed into a holder 92 accommodating the photointerrupter 88 in the handle mount 83. The detection plate 87 includes a light shield 93 at its rear end, or an end to be placed. The handle mount 83 includes a stopper 94 adjacent to the inlet of the holder 92. The stopper 94 comes in contact with the light shield 93 when the detection plate 87 swings outward, restricting the swingable position of the detection plate 87. The handle mount 83 receives, behind the through-hole 91, a coil spring 95 that urges the detection plate 87 toward an outward position at which the detection plate 87 comes in contact with the stopper 94.

The photointerrupter 88 includes a substrate 96. The substrate 96 is held in the lateral direction in a rear portion of the holder 92. The substrate 96 includes a photoreceiver 97 on its front surface. The photoreceiver 97 can detect the light shield 93 placed in the holder 92 in a contactless manner.

When the detection plate 87 is at the outward position, the light shield 93 is outside the photoreceiver 97 without blocking the light entering the photoreceiver 97. The photoreceiver 97 thus enters a non-detection state with no detection signal being output. When the detection plate 87 swings inward against the urging force from the coil spring 95, the side handle 25 comes in contact with a receiver 98 on the outer surface of the handle mount 83. At this inward position, the light shield 93 blocks light entering the photoreceiver 97. The photoreceiver 97 thus enters a detection state with a detection signal being output. The photointerrupter 88 includes a dust cover 88*a* covering the photoreceiver 97 and a part of the substrate 96 excluding a slit 88*b* through which the light shield 93 passes.

The gear housing 5 is fastened to the inner housing 3 with four screws 100 at four corners viewed from the front, which are placed from the front with the partition 69 between the gear housing 5 and the inner housing 3. A bevel gear 101 is fixed on the front end of the rotational shaft 65 protruding into the gear housing 5. As shown in FIG. 4, the bevel gear 101 meshes with a bevel gear 102 fixed on the upper end of the spindle 6. The gear housing 5 has, on its front surface, outlets 103 that communicate with the inner housing 3 through a through-hole (not shown) in the partition 69. A shaft lock 104 is located in front of the outlets 103. The shaft lock 104 can lock the spindle 6 not to rotate via the bevel gear 102 when pressed.

The spindle 6 is axially supported by upper and lower bearings 106, and protrudes downward. The upper bearing 106 is held on the gear housing 5. The lower bearing 106 is held on a bearing box 105 attached to the bottom of the gear housing 5. The spindle 6 has a lower end to receive a tip tool 107 (FIG. 4), such as a grinding disc. The bearing box 105 can receive, on its outer circumference, a wheel cover (not shown) covering a rear half of the tip tool 107.

In the grinder 1 according to the present embodiment, the threaded portion 26 of the side handle 25 is screwed into the screw hole 85 in either the right or left handle mount 83 through the through-hole 91 in the detection plate 87. The side handle 25 has a distal end 27 holding the threaded portion 26. The distal end 27 presses the detection plate 87 inward against the urging force from the coil spring 95, thus pressing the detection plate 87 against the receiver 98. In response to the side handle 25 attached, the detection plate 87 swings to the inward position and causes the light shield 93 to block light entering the photoreceiver 97 in the photointerrupter 88.

The operator rotates the lock-off lever 19 with fingers holding the rear cylinder 8 to unlock the lock-off lever 19, and then grips the switch lever 16. The pressing plate 18 presses the plunger 13 to first turn on the main switch 12. This allows the battery pack 11 to power the control circuit board 21 in the controller 20. The control circuit board 21 determines whether the photointerrupter 88 outputs a detection signal.

When the operator grips the switch lever 16 further, the lock-off lever 19 presses the button 15 in the microswitch 14 to turn on the microswitch 14. In response to a detection signal from the photointerrupter 88 and an on signal from the microswitch 14, the control circuit board 21 controls the battery pack 11 to power the brushless motor 4 and activate the brushless motor 4. More specifically, the microcomputer in the control circuit board 21 receives, from a rotation detection element in the sensor circuit board 38, a rotation detection signal indicating the positions of the permanent magnets 67 in the rotor 33, and determines the rotational state of the rotor 33. The microcomputer in the control circuit board 21 controls the on-off state of each FET in accordance with the determined rotational state, and applies a current through the coils 37 in the stator 32 sequentially to rotate the rotor 33. The rotational shaft 65 thus rotates and causes the spindle 6 to rotate (rotate clockwise as viewed from above) via the bevel gears 101 and 102 to allow grinding or other operations with the tip tool 107.

The rotor 33 in the brushless motor 4 that rotates at high speed and the tip tool 107 attached to the spindle 6 may cause unbalanced operations. This may cause vibrations to be transferred to the inner housing 3 and the gear housing 5.

The rubber cylinder 80 is held between the inner housing 3 and the outer housing 2 in the present embodiment. This structure effectively isolates such vibrations, thus reducing vibrations transferred to the outer housing 2. The operator is thus less likely to receive vibrations on his or her hand holding the rear cylinder 8 as a main handle. The side handle 25 is attached to the handle mount 83 on the outer housing 2, which also isolates vibrations. The operator is thus less likely to receive vibrations on his or her hand holding the side handle 25. This structure achieves lower vibrations.

When the brushless motor 4 is activated or the tip tool 107 receives a load during rotation, the inner housing 3 is urged to rotate counterclockwise (in a direction in which a reaction force is applied) about the connecting rod 75 as viewed in plan. The rubber cylinder 80 is held between the inner housing 3 and the outer housing 2 in the present embodiment. The rubber cylinder 80 thus absorbs the rotation of the inner housing 3 to reduce a reaction transferred to the outer housing 2 and the side handle 25 attached to the outer housing 2.

When the centrifugal fan 71 rotates together with the rotational shaft 65, the outside air is drawn through the inlets 23 behind the centrifugal fan 71, passes under the controller 20, and advances through the outer housing 2. This cools the controller 20 and the terminal mount 24.

The airflow in the outer housing 2 passes through the main switch 12 and the microswitch 14 while cooling them, enters the inner housing 3 through the through-holes 52 in the bearing retainer 50, and passes between the stator 32 and the rotor 33 in the brushless motor 4 to cool the brushless motor 4. The airflow then passes through the flared portion 30 and expanded portion 31 to the gear housing 5 through the partition 69, and is then discharged through the outlets 103.

The grinder 1 according to the present embodiment includes the inner housing 3 accommodating the brushless motor 4 (motor), the spindle 6 (final output shaft) in front of the brushless motor 4, and the outer housing 2 enclosing the inner housing 3 and integral with the rear cylinder 8 (handle). The inner housing 3 and the outer housing 2 are connected in a relatively rotatable manner with the connecting rod 75 (connecting shaft) parallel to the spindle 6. The inner housing 3 is held on the outer housing 2 with the rubber cylinder 80 (front elastic member) in between in front of the connecting rod 75. This structure effectively reduces vibrations and a reaction force transferred to the operator and improves usability and operability.

In particular, the connecting rod 75 is held with the rubber cap 78 (rear elastic member) in the outer housing 2. This effectively reduces vibrations transferred from the connecting rod 75 to the outer housing 2.

The outer housing 2 includes the handle mounts 83 (mounts to which the side handle is attachable). This also effectively prevents vibrations and a reaction force from being transferred to the side handle 25.

The outer housing 2 includes the pair of right and left half housings 2*a* and 2*b* that are assembled together. The half housings 2*a* and 2*b* are fixed to the fixing ring 81 (ring), which is externally mounted on the inner housing 3 with the rubber cylinder 80 in between. The half housings 2*a* and 2*b* are thus firmly joined together with the fixing ring 81 between them.

The joint 53 (a joint portion connected to the connecting shaft) in the inner housing 3 is formed from a metal to provide sufficient strength.

The inner housing 3 accommodates the brushless motor 4 in a cylindrical holder. The rubber cylinder 80 thus effectively isolates vibrations along the entire circumference.

The outer housing 2 accommodates the electric components other than the brushless motor 4, such as the main switch 12, the microswitch 14, the controller 20, and the terminal mount 24. These electric components are located apart from the brushless motor 4 and the tip tool 107, which are vibration sources, and located in a manner isolated from vibrations. This protects the electric components against vibrations.

The outer housing 2 includes the battery packs 11 (batteries) serving as a power supply. The outer housing 2 thus has an increased weight, effectively reducing vibrations.

The rubber cap 78 has a lower hardness than the rubber cylinder 80. This effectively prevents transfer of a reaction force.

The connecting shaft may be integral with the joint in the bearing retainer, instead of being separate from the bearing retainer, similarly to the connecting rod 75 in the present embodiment. The connecting shaft may be directly located on the inner housing without using a separate member such as a bearing retainer. The rear elastic member for elastically holding the connecting shaft may be eliminated.

The handle mounts may not be on the outer housing. A known structure including a side handle attached to a gear housing may also provide certain vibration reduction with the elastically held inner housing.

The outer housing may not be halved as in the present embodiment, but may be an integral cylinder similarly to the inner housing. The grinder may operate on an alternating current (AC) without including batteries or may include a motor other than a brushless motor.

The grinder 1 (power tool) according to the present embodiment includes the inner housing 3 accommodating the brushless motor 4 (motor), the spindle 6 (final output shaft) drivable by the brushless motor 4, and the outer housing 2 enclosing the inner housing 3 and integral with the rear cylinder 8 (handle). The inner housing 3 is held on the outer housing 2 with the rubber cylinder 80 (elastic member) in between. The outer housing 2 includes the handle mounts 83 (mounts to which the side handle is attachable) and the handle detectors 86 each for detecting the side handle 25 attached. More specifically, the handle detectors 86 are located on the outer housing 2, which is isolated using the rubber cylinder 80 from vibrations generated by the brushless motor 4 and the spindle 6 (tip tool 107). The grinder 1 thus includes the handle detectors 86 that are less susceptible to vibrations and are highly durable and reliable.

In particular, the handle detectors 86 each detect the side handle 25 attached, in response to an attaching operation of the side handle 25. The handle detectors 86 do not cause any additional operation for detection.

The handle detectors 86 are provided at multiple (two in the embodiment) locations. The side handle 25 attached is thus independently detectable on each handle mount 83.

The handle detectors 86 are located in right and left portions of the outer housing 2. The side handle 25 is thus detectable on either the right or left handle mount 83.

The inner housing 3 is connected to the outer housing 2 with the connecting rod 75 (connecting shaft) parallel to the spindle 6. This structure effectively reduces a reaction force transferred to the operator generated when the brushless motor 4 is activated or the tip tool 107 receives a load.

The handle detectors 86 operate in a contactless manner. The handle detectors 86 are less likely to have failures or erroneous detection caused by foreign matter such as dust, and are expected to have higher durability and reliability.

Each side handle detector 86 includes the detection plate 87 (detection member) having the front portion swingable about the pivot pin 90 (pivot). The detection plate 87 comes in contact with the side handle 25 when the side handle 25 is attached. The photointerrupter 88 (detector) located behind the detection plate 87 detects the detection plate 87 that swings when in contact with the side handle 25. The receiver 98 is located between the pivot pin 90 and the photointerrupter 88 to receive the side handle 25. The detection plate 87 thus reliably swings in response to an attaching operation of the side handle 25 to allow the photointerrupter 88 to detect the side handle 25 attached.

The photointerrupter 88 is covered with the dust cover 88*a*. This effectively prevents foreign matter such as dust from entering and improves the reliability of detection.

In the present embodiment, the positional relationship between the pivot pin and the photointerrupter is not limited to the relationship described above and may be modified as appropriate in accordance with the power tool used. For example, the pivot pin and the photointerrupter may be reversed in the front-rear direction or may be arranged in the vertical direction.

The sensor is not limited to a photointerrupter. The sensor may be another contactless sensor such as a proximity sensor including a magnet, or may be a contact sensor such as a microswitch or a pressure switch.

In the present embodiment, the handle detector is provided for each handle mount. In some embodiments, a single handle detector may be used for multiple handle mounts.

The present invention is applicable not only to a grinder but also to other power tools with a mount to which a side handle is attachable, such as an angle drill or a sander. When the inner housing and the outer housing are connected with the connecting shaft in a structure including a final output shaft facing other than downward, the connecting shaft may be aligned parallel to the final output shaft.

The tool may operate on an alternating current (AC) without including batteries or may include a motor other than a brushless motor.

REFERENCE SIGNS LIST

1 rechargeable grinder
2 outer housing
3 inner housing
4 brushless motor
5 gear housing
6 spindle
7 front cylinder
8 rear cylinder
9 battery mount
10 larger-diameter portion
11 battery pack
20 controller
25 side handle
26 threaded portion
30 flared portion
31 expanded portion
32 stator
33 rotor
50 bearing retainer
51 bearing holder
53 joint
61 lock ring
65 rotational shaft
75 connecting rod
76 rod receiver
78 rubber cap
80 rubber cylinder
81 fixing ring
83 handle mount
86 handle detector
87 detection plate
88 photointerrupter
93 light shield
97 photoreceiver
98 receiver
107 tip tool

What is claimed is:

1. A power tool capable of detecting a side handle attached, the power tool comprising:

a motor;

an inner housing accommodating the motor;

an elastic member;

a final output shaft driven by the motor;

an outer housing enclosing the inner housing and holding the inner housing with the elastic member in between, the outer housing including a mount to which the side handle is attachable, and at least one handle detector configured to detect the side handle attached; and a connecting shaft parallel to the final output shaft;

wherein the inner housing is connected to the outer housing with the connecting shaft.

2. The power tool according to claim 1, wherein the at least one handle detector detects the side handle attached, in response to an attaching operation of the side handle.

3. The power tool according to claim 2, wherein the at least one handle detector includes a plurality of handle detectors.

4. The power tool according to claim 2, wherein the at least one handle detector operates in a contactless manner.

5. The power tool according to claim 2, wherein the at least one handle detector includes a detection member configured to come in contact with the side handle when the side handle is attached, a sensor located behind the detection member having a front portion swingable about a pivot to detect the detection member that swings when coming in contact with the side handle, and a receiver located between the pivot and the sensor to receive the side handle.

6. The power tool according to claim 1, wherein the at least one handle detector includes a plurality of handle detectors.

7. The power tool according to claim 6, wherein the plurality of handle detectors are located in right and left portions of the outer housing.

8. The power tool according to claim 7, wherein the at least one handle detector operates in a contactless manner.

9. The power tool according to claim 7, wherein the at least one handle detector includes a detection member configured to come in contact with the side handle when the side handle is attached, a sensor located behind the detection member having a front portion swingable about a pivot to detect the detection member that swings when coming in contact with the side handle, and a receiver located between the pivot and the sensor to receive the side handle.

10. The power tool according to claim 6, wherein the at least one handle detector operates in a contactless manner.

11. The power tool according to claim 6, wherein the at least one handle detector includes a detection member configured to come in contact with the side handle when the side handle is attached, a sensor located behind the detection member having a front portion swingable about a pivot to detect the detection member that swings when coming in contact with the side handle, and a receiver located between the pivot and the sensor to receive the side handle.

12. The power tool according to claim 1, wherein the at least one handle detector operates in a contactless manner.

13. The power tool according to claim 1, further comprising:

a handle integral with the outer housing.

14. A power tool capable of detecting a side handle attached, the power tool comprising:

a motor;

an inner housing accommodating the motor;

an elastic member;

a final output shaft driven by the motor;

an outer housing enclosing the inner housing and holding the inner housing with the elastic member in between, the outer housing including a mount to which the side handle is attachable, and at least one handle detector configured to detect the side handle attached, wherein the at least one handle detector includes a detection member configured to come in contact with the side handle when the side handle is attached, a sensor located behind the detection member having a front portion swingable about a pivot to detect the detection member that swings when coming in contact with the side handle, and a receiver located between the pivot and the sensor to receive the side handle.

15. The power tool according to claim 14, wherein the at least one handle detector includes a dust cover covering the sensor.

* * * * *